US006428235B1

(12) United States Patent
Takanashi et al.

(10) Patent No.: US 6,428,235 B1
(45) Date of Patent: Aug. 6, 2002

(54) LIQUID APPLICATOR HAVING INK COLOR IDENTIFICATION

(75) Inventors: Kazuhiko Takanashi, Yokohama; Yoshiomi Konose, Gunma, both of (JP)

(73) Assignee: Mitsubishi Pencil Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/522,455

(22) Filed: Mar. 9, 2000

(30) Foreign Application Priority Data

Mar. 26, 1999 (JP) ..... 11-084522
Oct. 19, 1999 (JP) ..... 11-297293

(51) Int. Cl.[7] ..... B43K 5/00

(52) U.S. Cl. ..... 401/202; 401/192; 401/213; 401/243; 401/245; 401/246

(58) Field of Search ..... 401/198, 199, 401/223, 224, 225, 227–229, 202, 213, 243, 245–247, 262, 269, 17, 25, 192, 230

(56) References Cited

U.S. PATENT DOCUMENTS 607,398 A * 7/1898 Waterman ..... 401/225
1,762,554 A * 6/1930 Hume ..... 401/17
3,323,494 A * 6/1967 Mutschler ..... 401/202
3,917,416 A * 11/1975 Steyer ..... 401/25
D295,878 S * 5/1988 Lovell ..... D19/43
4,759,651 A * 7/1988 Manusch et al. ..... 401/202
4,979,840 A * 12/1990 Madaus et al. ..... 401/202
5,352,051 A * 10/1994 Tamura et al. ..... 401/198
5,451,113 A * 9/1995 Lund et al. ..... 401/192
5,915,871 A * 6/1999 Kobayashi et al. ..... 401/213
5,944,438 A * 8/1999 Koyama et al. ..... 401/227
5,971,647 A * 10/1999 Loulourgas ..... 401/202

OTHER PUBLICATIONS

Shwan Stabibilo's Catalog dated May 28,1992.*

* cited by examiner

*Primary Examiner*—Gregory Huson
*Assistant Examiner*—Tuan Nguyen
(74) *Attorney, Agent, or Firm*—Darby & Darby

(57) ABSTRACT

A writing implement having a cap member is provided and is a direct-flow type (liquid ink type) writing implement including: a barrel cylinder; a holder holding a pen core at a front end of the barrel cylinder and further having inside the barrel cylinder, an ink tank for storing a liquid ink and a collector for temporary retention thereof. The collector, barrel cylinder and ink tank are formed of a clear, transparent material. A mouthpiece at the outer periphery of the holder is formed of a resin material having the same color as the ink held in the ink tank or having the same color as the written ink. The barrel cylinder may have a partition wall, positioned near to the center, on the side (rear side) opposite to the position where the collector is arranged, forming an ink tank in a space inside the barrel between the rear end plate of the collector and the partition wall.

37 Claims, 8 Drawing Sheets

LIQUID APPLICATOR HAVING INK COLOR IDENTIFICATION

BACKGROUND OF THE INVENTION (1) Field of the Invention

The present invention relates to a writing implement which comprises a barrel cylinder, a holder holding a pen core at the front end of the barrel cylinder with a penpoint projected, and further having inside the barrel cylinder an ink tank for storing and supplying liquid ink to the pen core and a collector for temporarily retaining the ink that has overflowed due to pressure changes inside the ink tank.

(2) Description of the Prior Art

There are a variety of colors of inks for writing implements. It has been usual that the barrel cylinder is formed with the same color as the ink. However, in order to check the ink color and the residual ink quantity, there have been proposals and products in which the barrel cylinder with an ink tank incorporated therein is made up of a transparent resin.

Japanese Utility Model Application Laid-Open Sho 64 No.55086 discloses a writing implement in which an ink tank and a collector are incorporated in a transparent barrel cylinder.

Japanese Utility Model Publication Sho 61 No.40548 discloses a marking pen in which a cap made up of a transparent material is provided and a penpoint holder is formed with the ink color.

Japanese Utility Model Publication Hei 5 No.8157 discloses a configuration in which a partially transparent cap is provided, but this transparent portion is to allow the type of the pen element to be seen.

Japanese Utility Model registration No.2517490 discloses a pen for a plotter, in which an ink retaining element (collector) is formed with the ink color while the barrel cylinder is transparent.

However, the above configurations allow for easy view of the residual ink quantity, but there is no proposal concerning the checking of the residual quantity of ink in the collector. Further, there have been demands for techniques which allow for easy recognition of the ink color when the writing implement is unused or when it is displayed at the storefront, but no proposal.

As an example of a liquid applicator including writing implements, there is a configuration in which a temporal ink retaining element (to be also referred to as collector) is fitted inside the barrel cylinder and fixed therein so that the interior space of the barrel cylinder, from the rear of the collector, is utilized as an ink tank (c.f. Japanese Utility Model Application Laid-Open Hei 6 No.12083).

For the above writing implement, the storage amount of the ink tank depends upon the ink retaining capacity of the collector. Therefore, the above writing implement has drawbacks such as blotting etc., if the ink tank alone is made large. Conversely, if the collector is designed in conformity with the storage amount of the ink tank, a large collector is needed and hence the writing implement results a large diametric barrel configuration with a poor design flexibility.

To deal with this, the storage amount of the ink tank may be attempted to be reduced by shortening the rear part of the barrel cylinder. However, the length of the barrel cylinder cannot be much shortened from a viewpoint of its handleability as a writing implement.

So, a partition wall may be provided inside the barrel cylinder to form an ink tank between the partition wall and the rear end of the collector. However, when the barrel cylinder is made transparent, the partition wall becomes conspicuous producing a bad appearance. To avoid this, the partition wall may be shaded with an opaque paint printed on the outer peripheral surface of the ink tank, thus making the ink color difficult to be seen. Therefore, and also in view of improvement of the external appearance, there has been a need for an improved proposal.

Further, to provide a partition wall when a barrel cylinder is formed by resin molding, the rear end of the barrel cylinder needs to be open and hence should be closed by a tail plug. However, air is liable to be trapped when the tail plug is fitted to the rear end of the barrel cylinder, again posing difficulties in fitting the plug.

A variety of liquid applicators other than writing implements suffer the same drawbacks as above.

SUMMARY OF THE INVENTION

The present invention has been devised in view of the above prior art and it is therefore an object of the present invention to provide a writing implement having a collector, especially, a liquid ink type writing implement which allows the residual ink quantity and the ink color to be checked positively and easily.

It is another object of the present invention to provide a writing implement which allows the ink color to be checked positively and easily when the cap is covered in place.

It is a further object of the present invention to provide a liquid applicator which has an improved external appearance with an externally inconspicuous partition wall defining an ink tank formed inside the barrel cylinder and which allows for easy fitting of a tail plug to the rear end of the barrel cylinder.

In order to achieve the above object, the present invention is configured as follows:

In accordance with the first aspect of the present invention, a liquid applicator includes: a barrel cylinder having an ink tank for storing ink to be supplied to a pen core and a collector for temporary retention thereof; a holder holding the pen core at the front end of the barrel cylinder with a penpoint thereof projected; and a cap member for covering the penpoint when the penpoint is unused, and is characterized in that the holder, collector, barrel cylinder and ink tank are formed of clear, transparent materials.

In accordance with the second aspect of the present invention, a liquid applicator includes: a barrel cylinder having an ink tank for storing ink to be supplied to a pen core and a collector for temporary retention thereof; a holder holding the pen core at the front end of the barrel cylinder with a penpoint thereof projected; and a cap member for covering the penpoint when the penpoint is unused, and is characterized in that at least the outer peripheral portion of the holder is formed of a material having the same color as the ink inside the ink tank or a material having the same color as the written ink, and the collector, barrel cylinder and ink tank are formed of clear, transparent materials.

In accordance with the third aspect of the present invention, the liquid applicator having the above first feature is characterized in that the cap member covering the penpoint when the penpoint is unused has an inner cap therein, and the cap member is formed of a clear, transparent material while the inner cap is formed of a material having the same color as the ink inside the ink tank or a material having the same color as the written ink.

In accordance with the fourth aspect of the present invention, the liquid applicator having the above first feature is characterized in that the cap member covering the penpoint when the penpoint is unused has an inner cap therein, and the cap member and inner cap are formed of a clear, transparent material.

In accordance with the fifth aspect of the present invention, the liquid applicator having the above first feature is characterized in that the cap member covering the penpoint when the penpoint is unused has an inner cap therein, and the cap member and inner cap are formed of a material having the same color as the ink inside the ink tank or a material having the same color as the written ink.

In accordance with the sixth aspect of the present invention, the liquid applicator having the above second feature is characterized in that the cap member covering the penpoint when the penpoint is unused has an inner cap therein, and the cap member is formed of a clear, transparent material while the inner cap is formed of a material having the same color as the ink inside the ink tank or a material having the same color as the written ink.

In accordance with the seventh aspect of the present invention, the liquid applicator having the above second feature is characterized in that the cap member covering the penpoint when the penpoint is unused has an inner cap therein, and the cap member and inner cap are formed of a clear, transparent material.

In accordance with the eighth aspect of the present invention, the liquid applicator having the above second feature is characterized in that the cap member covering the penpoint when the penpoint is unused has an inner cap therein, and the cap member and inner cap are formed of a material having the same color as the ink inside the ink tank or a material having the same color as the written ink.

In accordance with the ninth aspect of the present invention, the liquid applicator having the above first feature is characterized in that the cap member covering the penpoint when the penpoint is unused is provided on the outer periphery thereof with a clip element, and the clip element is formed of a material having the same color as the ink inside the ink tank or a material having the same color as the written ink.

In accordance with the tenth aspect of the present invention, the liquid applicator having the above second feature is characterized in that the cap member covering the penpoint when the penpoint is unused is provided on the outer periphery thereof with a clip element, and the clip element is formed of a material having the same color as the ink inside the ink tank or a material having the same color as the written ink.

In accordance with the eleventh aspect of the present invention, the liquid applicator having the above third feature is characterized in that the cap member covering the penpoint when the penpoint is unused is provided on the outer periphery thereof with a clip element, and the clip element is formed of a material having the same color as the ink inside the ink tank or a material having the same color as the written ink.

In accordance with the twelfth aspect of the present invention, the liquid applicator having the above fourth feature is characterized in that the cap member covering the penpoint when the penpoint is unused is provided on the outer periphery thereof with a clip element, and the clip element is formed of a material having the same color as the ink inside the ink tank or a material having the same color as the written ink.

In accordance with the thirteenth aspect of the present invention, the liquid applicator having the above fifth feature is characterized in that the cap member covering the penpoint when the penpoint is unused is provided on the outer periphery thereof with a clip element, and the clip element is formed of a material having the same color as the ink inside the ink tank or a material having the same color as the written ink.

In accordance with the fourteenth aspect of the present invention, the liquid applicator having the above sixth feature is characterized in that the cap member covering the penpoint when the penpoint is unused is provided on the outer periphery thereof with a clip element, and the clip element is formed of a material having the same color as the ink inside the ink tank or a material having the same color as the written ink.

In accordance with the fifteenth aspect of the present invention, the liquid applicator having the above seventh feature is characterized in that the cap member covering the penpoint when the penpoint is unused is provided on the outer periphery thereof with a clip element, and the clip element is formed of a material having the same color as the ink inside the ink tank or a material having the same color as the written ink.

In accordance with the sixteenth aspect of the present invention, the liquid applicator having the above eighth feature is characterized in that the cap member covering the penpoint when the penpoint is unused is provided on the outer periphery thereof with a clip element, and the clip element is formed of a material having the same color as the ink inside the ink tank or a material having the same color as the written ink.

In accordance with the seventeenth aspect of the present invention, the liquid applicator having the above first feature is characterized in that the cap member covering the penpoint when the penpoint is unused is provided on the outer periphery thereof with a clip element, and the clip element is formed of a clear, transparent material.

In accordance with the eighteenth aspect of the present invention, the liquid applicator having the above second feature is characterized in that the cap member covering the penpoint when the penpoint is unused is provided on the outer periphery thereof with a clip element, and the clip element is formed of a clear, transparent material.

In accordance with the nineteenth aspect of the present invention, the liquid applicator having the above third feature is characterized in that the cap member covering the penpoint when the penpoint is unused is provided on the outer periphery thereof with a clip element, and the clip element is formed of a clear, transparent material.

In accordance with the twentieth aspect of the present invention, the liquid applicator having the above fourth feature is characterized in that the cap member covering the penpoint when the penpoint is unused is provided on the outer periphery thereof with a clip element, and the clip element is formed of a clear, transparent material.

In accordance with the twenty-first aspect of the present invention, the liquid applicator having the above fifth feature is characterized in that the cap member covering the penpoint when the penpoint is unused is provided on the outer periphery thereof with a clip element, and the clip element is formed of a clear, transparent material.

In accordance with the twenty-second aspect of the present invention, the liquid applicator having the above sixth feature is characterized in that the cap member covering the penpoint when the penpoint is unused is provided on the outer periphery thereof with a clip element, and the clip element is formed of a clear, transparent material.

In accordance with the twenty-third aspect of the present invention, the liquid applicator having the above seventh feature is characterized in that the cap member covering the penpoint when the penpoint is unused is provided on the outer periphery thereof with a clip element, and the clip element is formed of a clear, transparent material.

In accordance with the twenty-fourth aspect of the present invention, the liquid applicator having the above eighth feature is characterized in that the cap member covering the penpoint when the penpoint is unused is provided on the outer periphery thereof with a clip element, and the clip element is formed of a clear, transparent material.

In accordance with the twenty-fifth aspect of the present invention, the liquid applicator having any one of the above first through twenty-fourth features, further comprises a tail plug fitted at the rear end of the barrel cylinder, wherein the tail plug is formed of a material having the same color as the ink inside the ink tank or a material having the same color as the written ink.

In accordance with the twenty-sixth aspect of the present invention, a liquid applicator includes: a barrel cylinder having an ink tank; and a collector disposed inside the barrel cylinder for temporarily retaining overflowed ink due to pressure changes inside the ink tank, and is characterized in that the barrel cylinder has a partition wall, positioned near to the center, on the side opposite to the position where the collector is arranged, forming an ink tank in a space inside the barrel between the rear end of the collector and the partition wall and in that the outer periphery of the barrel cylinder is formed opaque around the partition wall.

In accordance with the twenty-seventh aspect of the present invention, the liquid applicator having the above twenty-sixth feature is characterized in that the opaque portion is formed by decalcomania (transfer printing) over the outer peripheral surface of the barrel cylinder.

In accordance with the twenty-eighth aspect of the present invention, the liquid applicator having the above twenty-sixth feature is characterized in that the opaque portion is gradated from the position of the partition wall toward the front so that the print density becomes lowered so as to be transparent and the color of the ink inside the ink tank can be seen from the outside.

In accordance with the twenty-nine aspect of the present invention, the liquid applicator having the above twenty-seventh feature is characterized in that the opaque portion is gradated from the position of the partition wall toward the front so that the print density becomes lowered so as to be transparent and the color of the ink inside the ink tank can be seen from the outside.

In accordance with the thirty aspect of the present invention, a liquid applicator includes: a barrel cylinder having an ink tank; and a collector disposed inside the barrel cylinder for temporarily retaining overflowed ink due to pressure changes inside the ink tank; and a tail plug for closing the rear end of the barrel cylinder, and is characterized in that the barrel cylinder has a partition wall, positioned near to the center, on the side opposite to the position where the collector is arranged, forming an ink tank in a space inside the barrel between the rear end of the collector and the rear end cylindrical part of the barrel cylinder that opens rearwards from the partition wall has an air vent configuration when the tail plug is closed.

According to the present invention, since the holder, collector, barrel cylinder and ink tank are formed of clear, transparent materials, it is possible to check not only the residual ink quantity in the ink tank but also that in the collector. Further, this configuration allows checking of the color of ink impregnating in the pen core. Therefore, this configuration is advantageous for the selection of ink color.

In accordance with the present invention, since at least the peripheral surface of the holder is formed of a material having the same color as the ink held in the ink tank or the same color as the written ink, this configuration allows for easy knowledge of the ink color or the color of the written ink. In particular, in the case where the color of the ink (the color of the written ink) when it is applied on a paper surface differs from the external appearance of the ink being stored in the ink tank, this configuration is markedly advantageous so that the user can chose a writing implement of a needed color without failure. Further, since the barrel cylinder and ink tank are formed of clear, transparent materials, it is also convenient for the user to be able to check not only the residual ink quantity in the ink tank but also that in the collector.

In the present invention, since an inner cap is provided inside the cap member for covering the penpoint when it is unused, if the cap member is formed of a clear, transparent material and the inner cap is formed of a material having the same color as the ink in the ink tank or a material having the same color as the written ink, it is possible to easily know the ink color or the color of the written ink even when the cap is fitted. In particular, this configuration facilitates the selection of a desired color, by customers, from those displayed at the storefront.

Further, when the cap member and inner cap are both formed of a clear, transparent material, the color of the ink can be directly viewed via the inner cap when the cap is fitted.

In the present invention, the clip element is provided on the outer periphery of the cap member and this clip is formed of a material having the same color as the ink inside the ink tank or having the same color as the written ink, so that it is possible to further easily know the ink color or the color of the written ink when the cap member is fitted. In particular, since the clip is externally and so easily viewed, this configuration facilitates the selection of a desired color, by customers, from those displayed at the storefront.

Alternatively, when the cap member is formed of a material having the same color as the ink in the ink tank or a material having the same color as the written ink while the clip element is formed of a clear, transparent material, the ink color or the color of the written ink can be externally and directly viewed when the cap is fitted.

Since a tail plug is fitted into the rear end of the barrel cylinder and this tail plug is formed of a material having the same color as the ink in the ink tank or a material having the same color as the written ink. Therefore, this configuration allows for further easy knowledge of the ink color or the color of the written ink no matter if the cap is fitted or not. In particular, since the tail plug is externally and so easily viewed even if the pens are displayed upside down at the storefront, this configuration increasingly facilitates the selection of a desired color by the customer.

Further, in accordance with the liquid applicator of the present invention, since the outer periphery of the barrel cylinder is formed opaque and gradated around the partition wall, the partition wall can be hidden in a smart manner.

Finally, since air can be relieved when the tail plug is put at the rear end of the barrel cylinder, the tail plug fitting work can be simplified. It is preferable as an air vent arrangement that longitudinal grooves are provided on the inner periphery of the rear opening end of barrel cylinder so that air is allowed to be released during fitting of the tail plug and t h e vent passage can be closed when the fitting is completed.

DESCRIPTION OF THE PREFERRED EMBODIMENTS

The embodiments of the present invention will hereinafter be described in detail with reference to the accompanying drawings.

Figure 1:
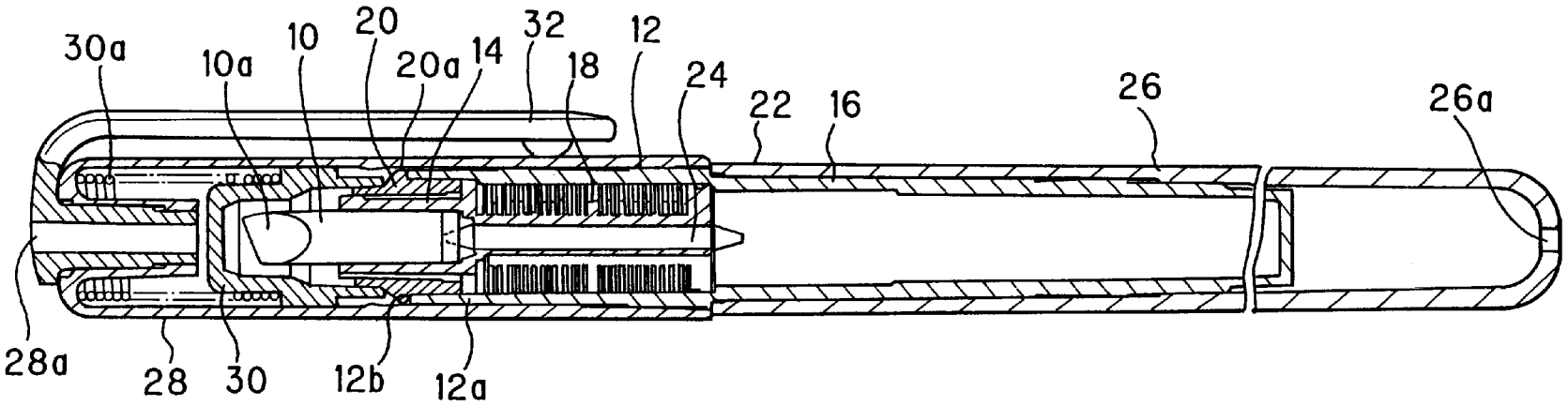
FIG. 1 is an illustrative diagram showing a writing implement in accordance with the first embodiment of the present invention.

FIG. 1 is a vertical sectional view showing a writing implement according to the first embodiment.

As shown in FIG. 1, this writing implement is a direct-flow type (liquid ink type) writing implement comprising: a barrel cylinder 12; a holder 14 holding a pen core 10 at a front end 12*a* of barrel cylinder 12 with a penpoint 10*a* of pen core 10 projected and further having inside barrel cylinder 12, an ink tank 16 for storing a liquid ink to be supplied to pen core 10 and a collector 18 for temporarily retaining the ink.

Holder 14 disposed at front end 12*a* of the barrel cylinder assumes a cylindrical shape and has pen core 10 fitted to and held by the inner periphery thereof. Arranged integrally from the rear end of this holder 14 are a number of discs in series around a cylindrical portion in the center of the discs, forming collector 18. A separate, more or less cylindrical, mouthpiece (which can also be referred to as mouthpiece plastic) 20 is fitted and integrally fixed on the outer periphery of holder 14. In this state, collector 18 and holder 14 are inserted into barrel cylinder 12 through a front end opening 12*b* and fixed thereto with the outer periphery at the rear end of collector 18 abutted against a stepped portion 22 that is projected inwardly towards the axial center inside barrel cylinder 12. Further, an annular projection 20*a* on the outer periphery of mouthpiece 20 abuts against the front brim of front end 12*a* of the barrel cylinder so that collector 18 and holder 14 are positioned with respect to barrel cylinder 12.

Fitted and fixed to the inner peripheral portion of collector 18 is an intermediary core 24 made up of a compressed fabric element having a solid cylindrical shape conically tapered at front and rear ends. The front end of intermediary core 24 is pierced into the rear end of pen core 10 while the rear end of intermediary core 24 is projected from the rear end of collector 18 and exposed inside ink tank 16.

The part of barrel cylinder 12, from the aforementioned stepped portion 22 to the rear, becomes tapered toward the rear end which is closed, defining ink tank 16 therein. A cylindrical, rear barrel 26 having a hole 26*a* at its rear end is fitted over the outer peripheral surface of ink tank 16.

In this configuration, mouthpiece 20 fitted on the outer periphery of holder 14 is formed of a material (preferably a plastic or other resins) having the same color as the ink held in ink tank 16 or the same color as the written ink. Preferably, when the mouthpiece is formed in the same color as the written ink, it is convenient for the user because they can positively check the ink color, which is needed.

In this embodiment, collector 18, barrel cylinder 12 and ink tank 16 are formed of clear, transparent materials (preferably a plastic or other resins). Holder 14 and collector 18 are integrally formed of the same clear, transparent material.

Front end part 12*a* of the barrel cylinder is adapted to be fitted with a cap member 28 for covering penpoint 10a when penpoint 10*a* is unused (during non-writing). This cap member 28 has a cup-shaped inner cap 30 therein and is formed of a clear, transparent material or a material having the same color as the ink held in ink tank 16 or the same color as the written ink, while inner cap 30 is formed of a clear, transparent material or a material having the same color as the ink held in ink tank 16 or the same color as the written ink. That is, an arbitrary combination of the transparency and opaqueness of this cap member 28 and inner cap 30 can be selected. Inner cap 30 is arranged so as to move forwards and backwards within cap member 28 and is urged rearwards by a spring 30*a* so that the rear end brim of inner cap 30 will hermetically abut on mouthpiece 20 and positively keep pen core 10*a* airtight when cap member 28 is fitted.

Cap member 28 has a top end opening 28*a* and an outer peripheral groove on inner cap 30. Therefore, regardless of the presence of inner cap 30, ventilation from the front to the rear end of cap member 28 can be established when cap member 28 is not fitted.

Cap member 28 has a clip element 32 on the outer periphery thereof so as to be able to be hooked when the pen is held in a clothes pocket. This clip 32 is formed of a material (preferably a plastic or other resins) having the same color as the ink held in the ink tank or the same color as the color of the written ink.

In accordance with the writing implement of the first embodiment, no matter if cap member 28 and inner cap 30 are transparent or opaque, mouthpiece 20 fitted on the outer periphery of holder 14 is formed of a material having the same color as the ink held in ink tank 16 or the same color as the written ink. Therefore, this configuration allows for easy knowledge of the ink color or the color of the written ink. In particular, in the case where the color of the ink when it is applied on a paper surface differs from the external appearance of the ink being stored in ink tank 16, this configuration is markedly advantageous so that the user can chose a writing implement of a needed color without failure.

Since collector 18, barrel cylinder 12 and ink tank 16 are formed of clear, transparent materials, it is also convenient for the user to be able to check not only the residual ink quantity in ink tank 16 but also that in the collector.

In the writing implement of the first embodiment, since inner cap 30 is provided inside cap member 28 for covering penpoint 10*a* when it is unused, if cap member 28 is formed of a clear, transparent material and inner cap 30 is formed of a material having the same color as the ink in ink tank 17 or a material having the same color as the written ink, it is possible to easily know the ink color or the color of the written ink even when cap member 28 is fitted. In particular, this configuration facilitates the selection of a desired color, by customers, from those displayed at the storefront. Further, when cap member 28 and inner cap 30 are both formed of a clear, transparent material, the color of the ink can be directly viewed via inner cap 30.

In this case, clip element 32 is provided on the outer periphery of cap member 28 and is formed of a material having the same color as the ink inside ink tank 16 or having the same color as the written ink, so that it is possible to further easily know the ink color or the color of the written ink when cap member 28 is fitted. In particular, since the clip is externally and so easily viewed, this configuration facilitates the selection of a desired color, by customers, from those displayed at the storefront.

Alternatively, when cap member 28 is formed of a material having the same color as the ink in ink tank 16 or a material having the same color as the written ink while clip element 32 is formed of a clear, transparent material, the ink color or the color of the written ink can be externally and directly viewed when the cap is fitted. It should be noted that a cartridge 38 shown in FIG. 3 may be used in place of ink tank 16 shown in FIG. 1.

Figure 2:
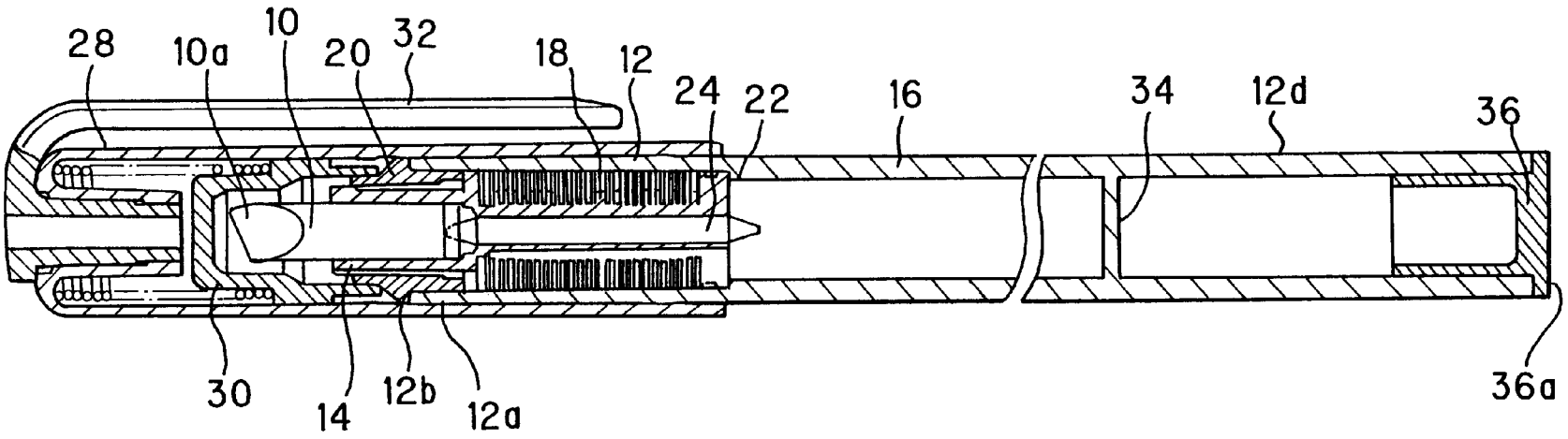
FIG. 2 is an illustrative diagram showing a writing implement in accordance with the second embodiment of the present Invention.

Next, a writing implement according to the second embodiment will be described referring to FIG. 2.

The writing implement of the second embodiment has a similar configuration to that of the first embodiment, so, like elements are allotted with like reference numerals without any description. The features are different from the first embodiment in that the rear portion of barrel cylinder 12 has a substantially constant outside diameter from the portion where collector 18 at the front part is located to the rear end and a partition wall 34 is arranged in the middle of the rear part forming an ink tank 16 in the front space of partition wall 34 while the aforementioned rear barrel 26 is omitted. Further, fitted in the rear of partition wall 34, at the rear end, designated at 12*d,* of the barrel cylinder is a cup-shaped tail plug 36 having a flange 36*a* protruded outwardly from the outer periphery of the rear end thereof.

Fitted into rear end 12*d* of the barrel cylinder is tail plug 36, which is formed of a material having the same color as the ink in ink tank 16 or a material having the same color as the written ink.

Therefore, this configuration allows for further easy knowledge of the ink color or the color of the written ink no matter if the cap is fitted or not. In particular, since tail plug 36 is externally and so easily viewed even if the pens are displayed upside down at the storefront, this configuration increasingly facilitates the selection of a desired color by the customer.

The above embodiment described is a preferred example of the present invention. However, the present invention should not be limited to this. For example, like a writing implement according to the third embodiment shown in FIG. 3, the ink tank may be configured as a cartridge 38 as stated above, which can be fitted through a cartridge insert portion formed at the rear end of barrel 12 so that cartridge 38 is set detachably to the ink tank. This configuration enables easy refilling of ink without dirtying the hands.

Figure 3:
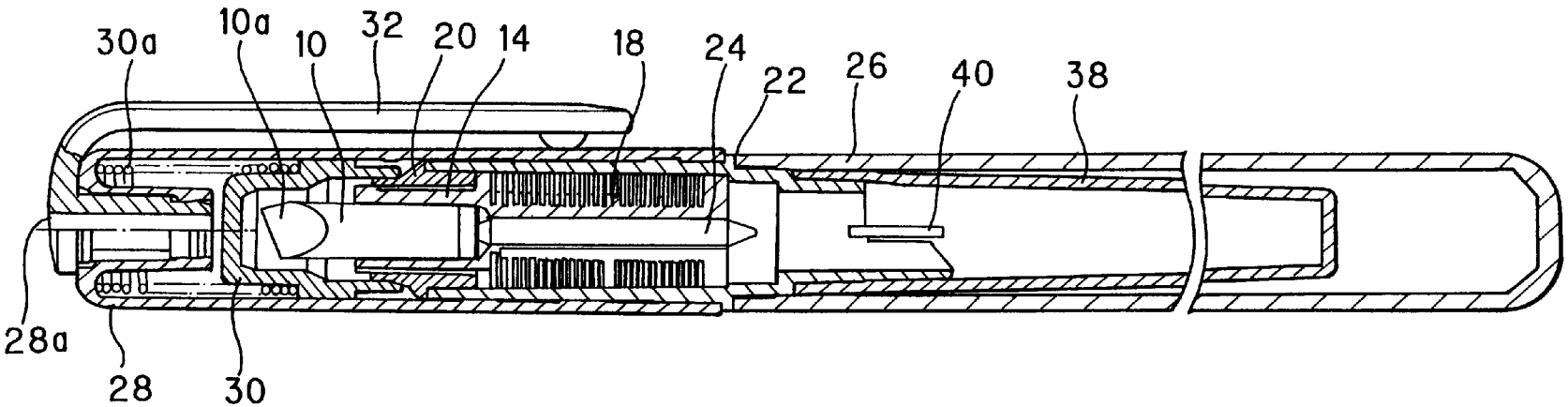
FIG. 3 is an illustrative diagram showing a writing implement in accordance with the third embodiment of the present invention.

Reference numeral 40 in FIG. 3 designates a lid element of cartridge 38. When the cartridge insert portion is pushed into cartridge 38, lid element 40 retracts into cartridge 38 and opens so that the ink can flow to intermediary core 24. Other parts are the same as in the first embodiment and the same components are allotted with the same reference numerals and description is omitted.

In the above first to third embodiments, the mouthpiece is imparted with the same color as the ink or with the same color as the written ink so as to permit simple knowledge of the ink color or the color of the ink written. However, the mouthpiece and holder may be formed to be clear and transparent so that a more improved direct view of the ink being stored can be obtained.

In the above embodiments, the separate holder and mouthpiece are assembled but the present invention should not be limited to this configuration. That is, these parts may be formed by two-color molding or may be integrally molded with the ink color or the color of the written ink.

Next, the fourth embodiment of the present invention will be described in detail with reference to the drawings.

Figure 4:
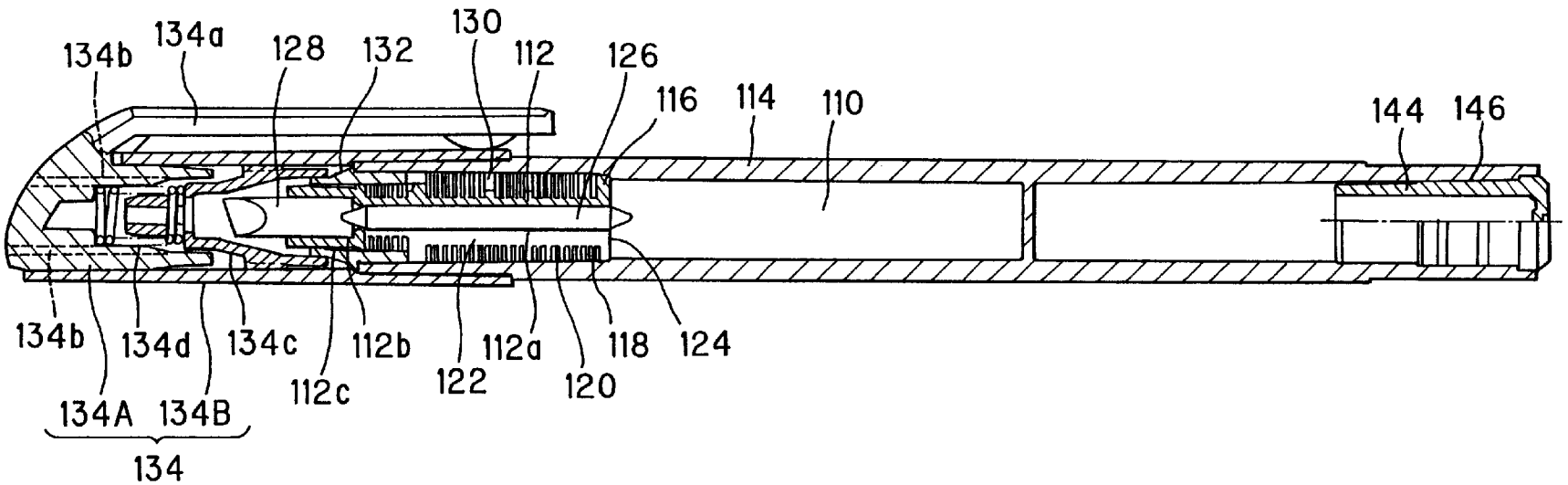
FIG. 4 is an overall vertical sectional illustrative diagram showing a writing implement in accordance with the fourth embodiment of the present invention.
Figure 5:
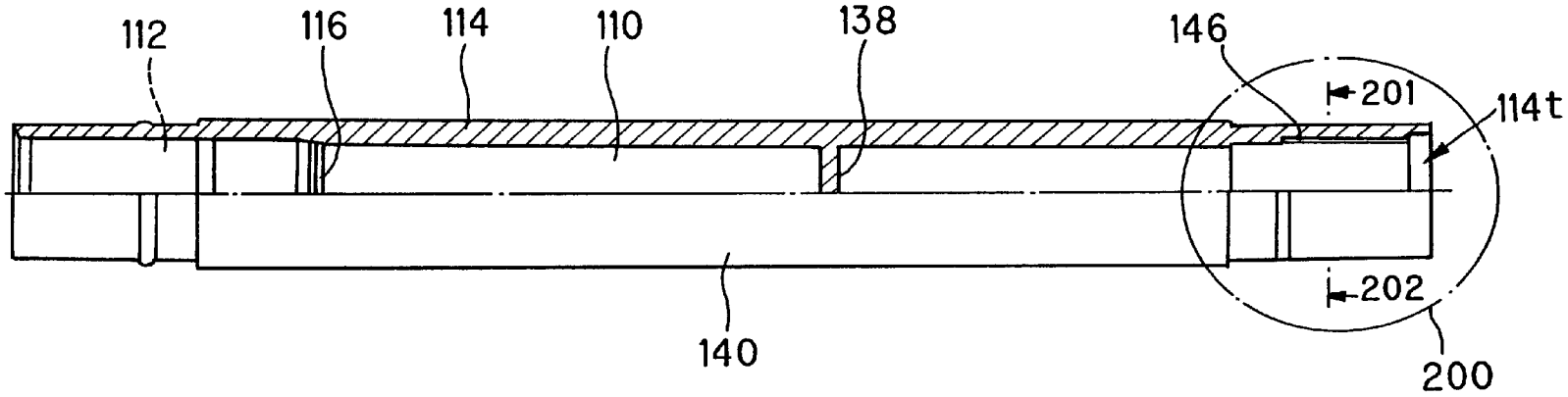
FIG. 5 is a half-sectional view showing a barrel cylinder.
Figure 6A:
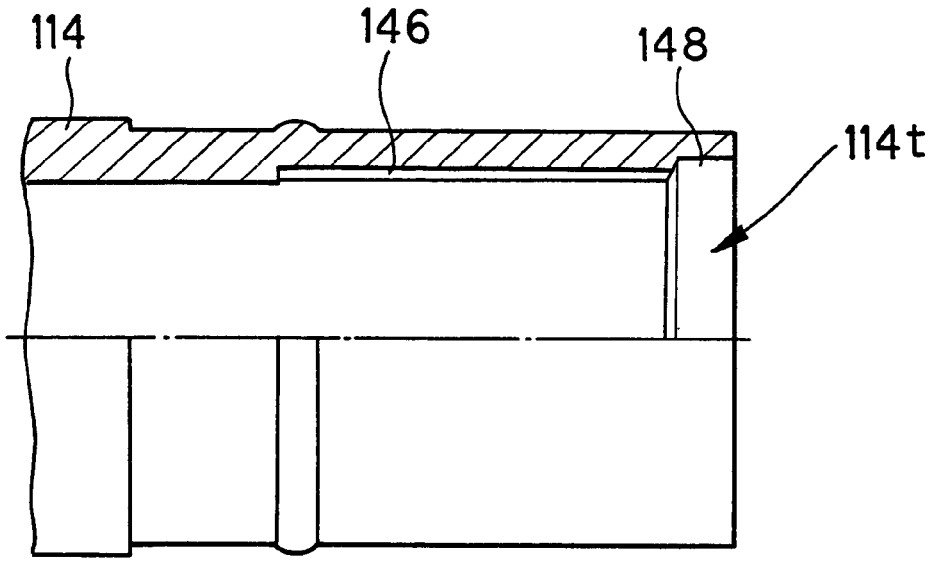
FIG. 6A is an enlarged view of an encircled portion 200 in FIG. 5
Figure 6B:
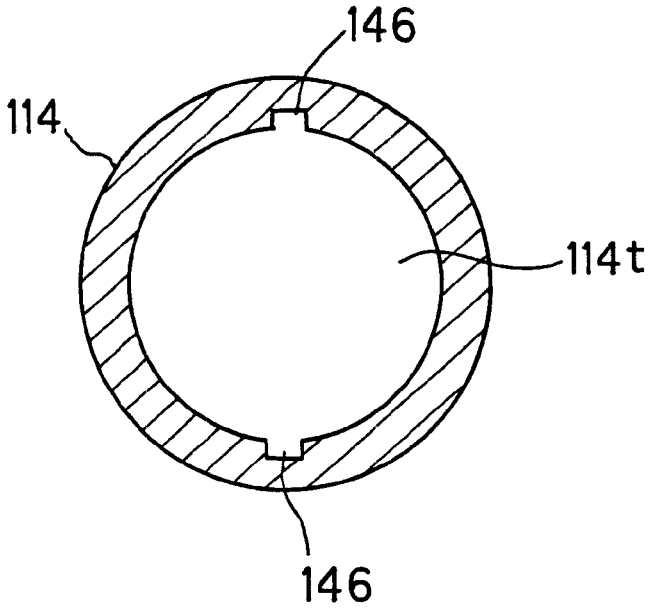
FIG. 6B shows a section cut along a line 201–202 in FIG. 5.
Figure 7:
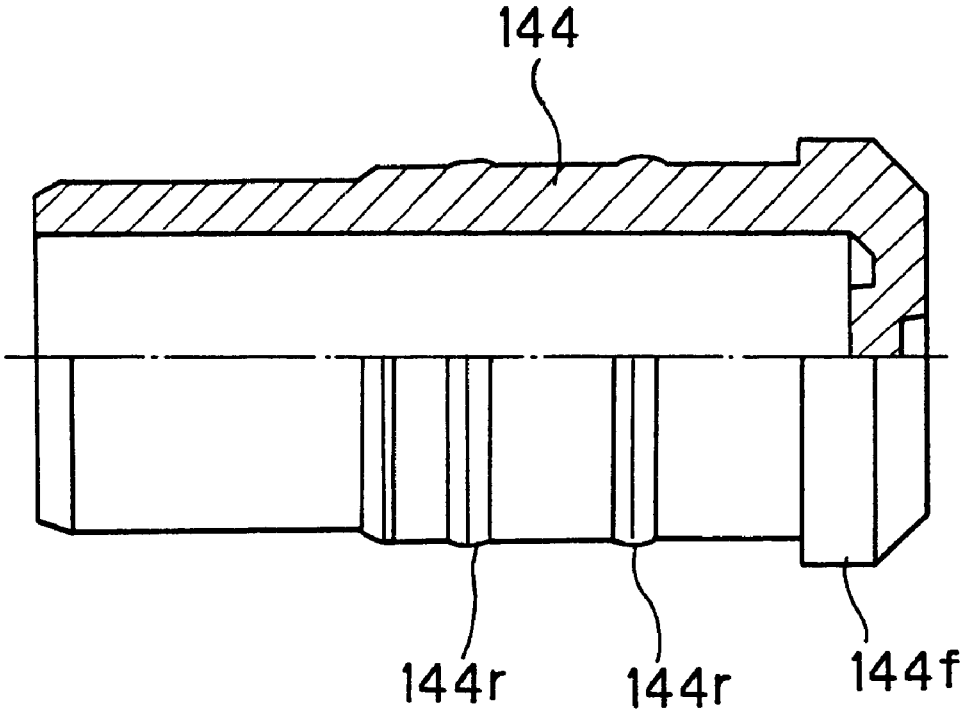
FIG. 7 is a detailed half-sectional view showing a tail plug.
Figure 8:
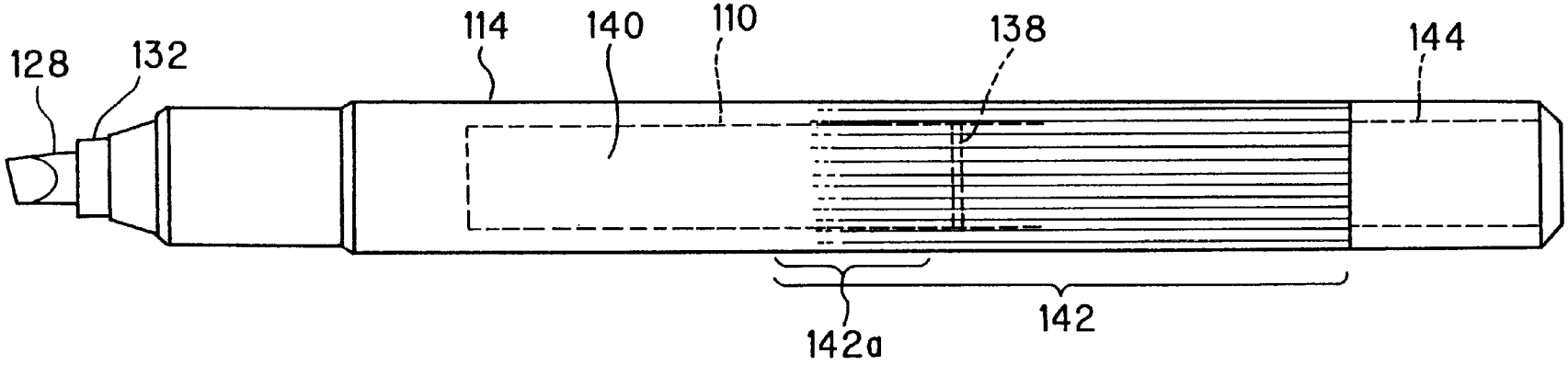
FIG. 8 is an external view showing a writing implement.

FIG. 4 is an overall vertical sectional illustrative diagram showing a writing implement in accordance with this embodiment. FIG. 5 is a half-sectional view showing a barrel cylinder. FIG. 6A is an enlarged view of an encircled portion 200 in FIG. 5. FIG. 6B shows a section cut along a line 201–202 in FIG. 5. FIG. 7 is a detailed half-sectional view showing a tail plug. FIG. 8 is an external view showing a writing implement.

As shown in FIG. 4, this writing implement has a collector 112 inside a barrel cylinder 114. This collector temporarily retains the overflowed ink in conformity with change in pressure inside an ink tank 110.

That is, this writing implement has collector 112 in front of ink tank 110. This collector 112 has an axial pipe portion and a disc plate 116 borne on the pipe portion at the rear end thereof with the outer periphery of plate 116 snugly fitted in contact with the inner periphery of a barrel cylinder 114, forming a water-tight configuration. A multiple number of thinner disc-shaped sheets 118 are arranged in front of this rear end plate 116. These thin sheets 118, 118, 118, . . . define ink retaining grooves (transverse grooves) 120 for retaining ink in their voids by capillary action, forming an ink retaining portion.

Formed in multiple thin sheets 118 except the axial pipe portion at their center is a slit-like ink feed groove (longitudinal groove) 122 along the length of collector 112. The groove width of this ink feed groove 122 is smaller than any of the groove widths of ink retaining grooves 120 and always filled with ink so that surplus ink can be fed into ink retaining grooves 120 as soon as the pressure in ink tank 110 rises.

Ink feed groove 122 is formed across all thin sheets 118 and also connected to an open groove 124 formed in plate 116 that is the entrance to ink tank 110.

Thin plates 118 in collector 112 are supported on axial hollow pipe portion 112*a* and integrally formed therewith.

Put into the hollow space of axial pipe portion 112*a* is an intermediary core 126 made up of a fabric core. This intermediary core 126 feeds the ink inside ink tank 110 to a penpoint 128 disposed at the front end of barrel cylinder 114. Penpoint 128 may be of a felt pen, ball-point pen, etc.

Formed on the outer periphery of thin sheets 118 of collector 112 are cutouts 130 arranged along the length of collector 112, forming an air channel. Penpoint 128 is mounted to a large-diametric pipe portion 112*b* extending from the front end of collector 112. Fitted between the outer periphery of the front part of collector 112 including large-diametric pipe portion 112*b* and the inner periphery of the front part of barrel cylinder 114 is a holder 132 so as to keep collector 112 from falling out of barrel cylinder 114.

A groove 112*c* is formed on the outer periphery of large-diametric pipe portion 112*b* so as to create an air channel with the inner periphery of holder 132. This air channel is connected to the above-mentioned open groove 124 by way of the air channel defined by cutouts 130, to thereby perform smooth gas-liquid replacement of ink tank 110.

When the writing element is unused, a cap 134 having a closed end for capping penpoint 128 is detachably disposed so as to cover barrel cylinder 114 up to the halfway point of the mounted position of collector 112.

Cap 134 is composed of a top, lid-like member 134A fitted into cylindrical side member 134B. Lid-like member 134A is integrally formed with a clip 134*a* and has air vent holes 134*b* penetrating therethrough from the top.

Cap 134 incorporates a cup-shaped inner cap 134*c* covering penpoint 128 and fitting to the front end of holder 132. This inner cup 134*c* is movable forwards and backwards by means of a spring 134*d*. Inner cap 134*c* fits to the front end of holder 132 first, at the moment that cap 134 is fitted to barrel cylinder 114. In this state, cap 134 has not completely fitted to barrel cylinder 114. A further pressing of cap 134 causes spring 134*d* to push inner cap 134*c* while an engaging arrangement on the inner side of the open end of cap 134 fits the barrel cylinder so that the cap is fixed thereto.

Here, as shown in FIG. 5, barrel cylinder 114 has a partition wall 138, positioned near to the center on the side (rear side) opposite to the position where collector 112 is arranged, forming ink tank 110 in a space between plate 116 at the rear end of collector 112 and partition wall 138.

As shown in FIG. 8, an opaque print surface 142 is formed on an outer peripheral side 140 of barrel cylinder 114 around the position of partition wall 138. This opaque print surface 142 is formed by decalcomania (transfer printing). A front part 142*a* of this print surface 142 is gradated so that the print density becomes lowered and hence the ink color can be seen from the position where print becomes transparent and disappears. Further, the presence of gradation make burrs at the end of decalcomania (transfer printing) inconspicuous.

As shown in FIGS. 6A and 6B, the cylindrical part extending from the rear of partition wall 138 of barrel cylinder 114 has a rear opening 114t that opens to the rear is closed by a tail plug 144. This tail plug 144 has a substantially cylindrical shape open to the front as shown in FIG. 7 and has a closed rear end having a flange 114*f* projected radially outwardly therefrom. Here, projectively formed on the side surface of tail plug 144 are ribs 144*r* in order to enhance its contact with the rear interior surface of the barrel cylinder.

Further, as shown in FIGS. 6A and 6B, the rear part of barrel cylinder 114, which will be closed by fitting of tail plug 144, has an arbitrary number, for example, a pair of, longitudinal grooves 146 formed on the inner peripheral surface, as an air vent configuration. When tail plug 144 is squeezed into the opening at the rear end of the barrel cylinder, if there are no longitudinal grooves 146, the internal pressure of the internal space on the rear side of partition wall 138 inside barrel cylinder 114 becomes higher as the squeezed distance of tail plug 144 increases and hence impedes the progress of the tail plug. In this embodiment, no interior pressure rise occurs since air escapes through the aforementioned longitudinal grooves 146. As a result, it is possible to move tail plug 144 forwards, without substantial force, and fit it snugly. It should be noted that a stepped portion 148 is formed in the inner brim of rear end opening 114t of the barrel cylinder so as to mate flange 144*f* of tail plug 144, thus hiding longitudinal grooves 146 for improved external appearance.

In the description of the above embodiments, the present invention is applied to a writing implement. However, the present invention can also be applied to applicators for correction liquid, applicators for cosmetics and other applicators.

As has been described heretofore, according to the present invention, since the holder, collector, barrel cylinder and ink tank are formed of clear, transparent materials, it is convenient for the user to be able to check not only the residual ink quantity in the ink tank but also that in the collector.

In accordance with the present invention, since at least the peripheral surface of the holder is formed of a material having the same color as the ink held in the ink tank or the same color as the written ink, this configuration allows for easy knowledge of the ink color or the color of the written ink. In particular, in the case where the color of the ink when it is applied on a paper surface differs from the external appearance of the ink being stored in the ink tank, this configuration is markedly advantageous so that the user can chose a writing implement of a needed color without failure. Further, since the collector, barrel cylinder and ink tank are formed of clear, transparent materials, it is also convenient for the user to be able to check not only the residual ink quantity in the ink tank but also that in the collector.

In the present invention, since an inner cap is provided inside the cap member for covering the penpoint when it is unused, if the cap member is formed of a clear, transparent material and the inner cap is formed of a material having the same color as the ink in the ink tank or a material having the same color as the written ink, it is possible to easily know the ink color or the color of the written ink even when the cap is fitted. In particular, this configuration facilitates the selection of a desired color, by customers, from those displayed at the storefront.

Further, when the cap member and inner cap are both formed of a clear, transparent material, the color of the ink can be directly viewed via the inner cap when the cap is fitted.

In this case, the clip element is provided on the outer periphery of the cap member and this clip is formed of a material having the same color as the ink inside the ink tank or having the same color as the written ink, so that it is possible to further easily know the ink color or the color of the written ink when the cap member is fitted. In particular, since the clip is externally and so easily viewed, this configuration facilitates the selection of a desired color, by customers, from those displayed at the storefront.

Since a tail plug is fitted into the rear end of the barrel cylinder and this tail plug is formed of a material having the same color as the ink in the ink tank or a material having the same color as the written ink. Therefore, this configuration allows for further easy knowledge of the ink color or the color of the written ink no matter if the cap is fitted or not. In particular, since the tail plug is externally and so easily viewed even if the pens are displayed upside down at the storefront, this configuration increasingly facilitates the selection of a desired color by the customer.

Alternatively, when the cap member is formed of a material having the same color as the ink in the ink tank or a material having the same color as the written ink while the clip element is formed of a clear, transparent material, the ink color or the color of the written ink can be externally and directly viewed when the cap is fitted.

Moreover, according to the present invention, the partition wall defining the ink tank inside the barrel cylinder can be made externally inconspicuous allowing for improved external appearance. Further, the tail plug to be fitted to the rear end of the barrel cylinder can be fitted easily.

What is claimed is:

1. A liquid applicator comprising:

a barrel cylinder having an ink tank for storing ink to be supplied to a pen core and an ink collector for temporary retention of the ink;

a holder holding the pen core at the front end of the barrel cylinder with a penpoint thereof projected;

a mouthpiece fittingly retained around an outer periphery of the holder; and a cap member for covering the penpoint when the penpoint is unused, the cap member including an inner cap disposed therein, the inner cap fittingly retained around an outer periphery of the mouthpiece when the cap member covers the penpoint and a front end of the ink tank being fittingly retained around the outer periphery of the mouthpiece, characterized in that each of the holder, collector, barrel cylinder and ink tank is formed of a clear, transparent material.

2. The liquid applicator according to claim 1, wherein the cap member is formed of a clear, transparent material while the inner cap is formed of a material having the same color as the ink inside the ink tank or a material having the same color as the written ink.

3. The liquid applicator according to claim 2, wherein the cap member covering the penpoint when the penpoint is unused is provided on the outer periphery thereof with a clip element, and the clip element is formed of a material having the same color as the ink inside the ink tank or a material having the same color as the written ink.

4. The liquid applicator according to claim 2, wherein the cap member covering the penpoint when the penpoint is unused is provided on the outer periphery thereof with a clip element, and the clip element is formed of a clear, transparent material.

5. The liquid applicator according to claim 1, wherein the cap member and the inner cap are formed of a clear, transparent material.

6. The liquid applicator according to claim 5, wherein the cap member covering the penpoint when the penpoint is unused is provided on the outer periphery thereof with a clip element, and the clip element is formed of a material having the same color as the ink inside the ink tank or a material having the same color as the written ink.

7. The liquid applicator according to claim 5, wherein the cap member covering the penpoint when the penpoint is unused is provided on the outer periphery thereof with a clip element, and the clip element is formed of a clear, transparent material.

8. The liquid applicator according to claim 1, wherein the cap member and inner cap are formed of a material having the same color as the ink inside the ink tank or a material having the same color as the written ink.

9. The liquid applicator according to claim 8, wherein the cap member covering the penpoint when the penpoint is unused is provided on the outer periphery thereof with a clip element, and the clip element is formed of a material having the same color as the ink inside the ink tank or a material having the same color as the written ink.

10. The liquid applicator according to claim 8, wherein the cap member covering the penpoint when the penpoint is unused is provided on the outer periphery thereof with a clip element, and the clip element is formed of a clear, transparent material.

11. The liquid applicator according to claim 1, wherein the cap member covering the penpoint when the penpoint is unused is provided on the outer periphery thereof with a clip element, and the clip element is formed of a material having the same color as the ink inside the ink tank or a material having the same color as the written ink.

12. The liquid applicator according to claim 1, wherein the cap member covering the penpoint when the penpoint is unused is provided on the outer periphery thereof with a clip element, and the clip element is formed of a clear, transparent material.

13. The liquid applicator according to claim 1, further comprising a tail plug fitted at the rear end of the barrel cylinder, wherein the tail plug is formed of a material having the same color as the ink inside the ink tank or a material having the same color as the written ink.

14. The liquid applicator according to claim 1, wherein the barrel cylinder has a partition wall, positioned near to the center, on the side opposite to the position where the collector is arranged, forming the ink tank in a space inside the barrel between a rear end of the collector and the partition wall and in that an outer periphery of the barrel cylinder is opaque around the partition wall.

15. The liquid applicator according to claim 14, wherein the opaque portion is formed by decalcomania (transfer printing) over the outer peripheral surface of the barrel cylinder.

16. The liquid applicator according to claim 15, wherein the opaque portion is gradated from the position of the partition wall toward the front so that the print density becomes lowered so as to be transparent and the color of the ink inside the ink tank can be seen from the outside.

17. The liquid applicator according to claim 14, wherein the opaque portion is gradated from the position of the partition wall toward the front so that the print density becomes lowered so as to be transparent and the color of the ink inside the ink tank can be seen from the outside.

18. The liquid applicator of claim 14, wherein the collector has an ink conduit extending therethrough and in communication with the ink tank.

19. The liquid applicator of claim 14, wherein the collector is disposed between and abuts against an inner surface of the barrel cylinder.

20. The liquid applicator of claim 1, wherein the holder, ink collector and the barrel cylinder are arranged to permit visual identification of ink within the ink collector when the applicator is in an assembled state.

21. A liquid applicator comprising:

a barrel cylinder having an ink tank for storing ink to be supplied to a pen core and an ink collector for temporal retention of the ink;

a holder holding the pen core at a front end of the barrel cylinder with a penpoint thereof projected;

a mouthpiece fittingly retained around an outer periphery of the holder; and a cap member for covering the penpoint when the penpoint is unused, the cap member including an inner cap disposed therein, the inner cap fittingly retained around an outer periphery of the mouthpiece when the cap member covers the penpoint and a front end of the ink tank being fittingly retained around the outer periphery of the mouthpiece, characterized in that at least an outer peripheral portion of the holder is formed of a material having the same color as the written ink, and the ink collector, barrel cylinder and ink tank are formed of clear, transparent materials.

22. The liquid applicator according to claim 21, wherein the cap member is formed of a clear, transparent material while the inner cap is formed of a material having the same color as the ink inside the ink tank or a material having the same color as the written ink.

23. The liquid applicator according to claim 22, wherein the cap member covering the penpoint when the penpoint is unused is provided on the outer periphery thereof with a clip element, and the clip element is formed of a material having the same color as the ink inside the ink tank or a material having the same color as the written ink.

24. The liquid applicator according to claim 23, further comprising a tail plug fitted at the rear end of the barrel cylinder, wherein the tail plug is formed of a material having the same color as the ink inside the ink tank or a material having the same color as the written ink.

25. The liquid applicator according to claim 22, wherein the cap member covering the penpoint when the penpoint is unused is provided on the outer periphery thereof with a clip element, and the clip element is formed of a clear, transparent material.

26. The liquid applicator according to claim 22, further comprising a tail plug fitted at the rear end of the barrel cylinder, wherein the tail plug is formed of a material having the same color as the ink inside the ink tank or a material having the same color as the written ink.

27. The liquid applicator according to claim 21, wherein the cap member and inner cap are formed of a clear, transparent material.

28. The liquid applicator according to claim 27, wherein the cap member covering the penpoint when the penpoint is unused is provided on the outer periphery thereof with a clip element, and the clip element is formed of a material having the same color as the ink inside the ink tank or a material having the same color as the written ink.

29. The liquid applicator according to claim 27, wherein the cap member covering the penpoint when the penpoint is unused is provided on the outer periphery thereof with a clip element, and the clip element is formed of a clear, transparent material.

30. The liquid applicator according to claim 21, wherein the cap member and inner cap are formed of a material having the same color as the ink inside the ink tank or a material having the same color as the written ink.

31. The liquid applicator according to claim 30, wherein the cap member covering the penpoint when the penpoint is unused is provided on the outer periphery thereof with a clip element, and the clip element is formed of a material having the same color as the ink inside the ink tank or a material having the same color as the written ink.

32. The liquid applicator according to claim 30, wherein the cap member covering the penpoint when the penpoint is unused is provided on the outer periphery thereof with a clip element, and the clip element is formed of a clear, transparent material.

33. The liquid applicator according to claim 21, wherein the cap member covering the penpoint when the penpoint is unused is provided on the outer periphery thereof with a clip element, and the clip element is formed of a material having the same color as the ink inside the ink tank or a material having the same color as the written ink.

34. The liquid applicator according to claim 33, further comprising a tail plug fitted at the rear end of the barrel cylinder, wherein the tail plug is formed of a material having the same color as the ink inside the ink tank or a material having the same color as the written ink.

35. The liquid applicator according to claim 21, wherein the cap member covering the penpoint when the penpoint is unused is provided on the outer periphery thereof with a clip element, and the clip element is formed of a clear, transparent material.

36. The liquid applicator according to claim 21, further comprising a tail plug fitted at the rear end of the barrel cylinder, wherein the tail plug is formed of a material having the same color as the ink inside the ink tank or a material having the same color as the written ink.

37. The liquid applicator of claim 21, wherein the ink tank, ink collector and the barrel cylinder are arranged to permit visual identification of ink within the ink tank and the ink collector when the applicator is in an assembled state.

* * * * *